United States Patent [19]

Takeuchi et al.

[11] 4,414,044

[45] Nov. 8, 1983

[54] WATER-IN-OIL EMULSION EXPLOSIVE COMPOSITION

[75] Inventors: Fumio Takeuchi; Masao Takahashi, both of Aichi, Japan

[73] Assignee: Nippon Oil and Fats, Co., Ltd., Tokyo, Japan

[21] Appl. No.: 372,131

[22] Filed: Apr. 27, 1982

[30] Foreign Application Priority Data

| | | | |
|---|---|---|---|
| May 11, 1981 | [JP] | Japan | 56-69282 |
| May 12, 1981 | [JP] | Japan | 56-70181 |
| May 12, 1981 | [JP] | Japan | 56-70182 |

[51] Int. Cl.[3] ..... C06B 45/00

[52] U.S. Cl. ..... 149/2; 149/21; 149/46; 149/41; 149/60; 149/61

[58] Field of Search ..... 149/2, 21, 46, 60, 61, 149/41

[56] References Cited

U.S. PATENT DOCUMENTS

| | | | |
|---|---|---|---|
| 3,765,964 | 10/1973 | Wade | 149/2 |
| 4,110,134 | 8/1978 | Wade | 149/2 |
| 4,218,272 | 8/1980 | Brockington | 149/2 |
| 4,322,258 | 3/1982 | Sudweeks et al. | 149/2 |
| 4,326,900 | 4/1982 | Hattori et al. | 149/2 |

*Primary Examiner*—Stephen J. Lechert, Jr.
*Attorney, Agent, or Firm*—Parkhurst & Oliff

[57] ABSTRACT

A water-in-oil emulsion explosive composition comprising an aqueous solution of ammonium nitrate alone or in admixture with the other inorganic oxidizer salt, fuel oil and/or wax, an emulsifier of dipentaerythritol fatty acid ester, polyoxyalkylenedipentaerythritol fatty acid ester, sugar fatty acid ester, polyoxyalkylenesugar fatty acid ester or sorbitol fatty acid ester, and hollow microspheres or microbubbles, has excellent storage stability in the detonation sensitivity in a small diameter cartridge and at low temperature.

8 Claims, No Drawings

WATER-IN-OIL EMULSION EXPLOSIVE COMPOSITION

BACKGROUND OF THE INVENTION (1) Field of the Invention

The present invention relates to a water-in-oil emulsion explosive composition (hereinafter, abbreviated as W/O emulsion explosive composition), and more particularly relates to a W/O emulsion explosive composition containing a novel emulsifier, which can form W/O emulsion, and having a performance superior to conventional W/O emulsion explosive compositions containing a commonly known emulsifier in the storage stability in the detonation sensitivity in a small diameter cartridge (diameter: 25 mm) and at low temperature.

(2) Description of the Prior Art

There have been variously investigated W/O emulsion explosive compositions for a long period of time. However, W/O emulsion explosive compositions produced in the early stage investigation are unstable in their emulsion state (that is, the contact area of the disperse phase and the continuous phase is relatively small), and therefore in almost all of the initial stage W/O emulsion explosive compositions, their detonation sensitivity in a small diameter cartridge was improved by compounding thereto an explosive sensitizer, such as nitroglycerine or the like, or a nonexplosive sensitizer, such as monomethylamine nitrate or the like (hereinafter these explosive sensitizer and nonexplosive sensitizer are referred to as sensitive substances), a detonation-catalytic sensitizer, such as a compound of metals having an atomic number of at least 13 and being other than the metals of Groups I and II in the Periodic Table, a strontium compound or the like, or a sensitive oxidizer, such as perchlorate or the like of ammonium or alkali metals (hereinafter, these detonation-catalytic sensitizer and sensitive oxidizer are referred to as auxiliary sensitive substances). However, W/O emulsion explosive compositions containing the above described sensitive substance or auxiliary sensitive substance have the dangerous property that, when the sensitive substance or auxiliary sensitive substance is separated at the production of the W/O emulsion explosive composition or during the use thereof, the explosive composition becomes very sensitive, or the toxic property of the sensitive or auxiliary sensitive substance appears. In order to obviate these drawbacks, there have been proposed W/O emulsion explosive compositions having an improved detonation sensitivity in a small diameter cartridge (capable of being detonated by a blasting cap) without containing any of the above described sensitive substances and auxiliary sensitive substances.

For example, U.S. Pat. No. 4,110,134 discloses that W/O emulsion explosive compositions, which contain an emulisifier of sorbitan fatty acid ester, glycerine fatty acid ester, polyoxyethylene sorbitol fatty acid ester, polyoxyethylene ether, polyoxyalkylene oleic acid ester, polyoxyalkylene lauric acid ester, phosphoric acid oleic acid ester, substituted oxazoline or phosphoric acid ester and which further contain a gas-retaining agent of glass microballoon, can be completely detonated up to a density of maximum 1.25 in a cartridge diameter of about 1.25 inches (31.8 mm) by means of a No. 6 blasting cap.

U.S. Pat. No. 4,149,917 discloses that W/O emulsion explosive compositions, which contain an emulsifier of sorbitan fatty acid ester, glycerine fatty acid ester, polyoxyethylene sorbitol fatty acid ester, polyoxyethylene(4) lauryl ether, polyoxyethylene(2) ether, polyoxyethylene(2) stearyl ether, polyoxyalkylene oleic acid ester, polyoxyalkylene lauric acid ester, phosphoric acid oleic acid ester, substituted oxazoline, phosphoric acid ester or their mixture and whose density has been adjusted to 0.95 by microbubbles without the use of a gas-retaining agent can be completely detonated (explosive temperature: 21.1° C.) in a cartridge diameter of 1.25 inches (31.8 mm) by means of a No. 6 blastic cap even after the lapse of time of 2 months and by means of a No. 8 blasting cap even after the lapse of time of 8 months after the production of the explosive composition.

Therefore, it is commonly known that various emulsifiers are used in a W/O emulsion explosive composition not containing the above described sensitive substance or auxiliary sensitive substance. Further, there are known various emulsifiers capable of forming W/O emulsion. However, W/O emulsion explosive compositions using an emulsifier other than that disclosed in the above described U.S. patents use the above described sensitive substance or auxiliary sensitive substance. This fact shows that the W/O emulsion is poor in storage stability, and the W/O emulsion explosive composition is very poor in storage stability in detonation sensitivity in a small diameter cartridge (diameter: 25 mm) and at low temperature.

The W/O emulsion explosive composition using the emulsifier described in the above described U.S. patents are still insufficient in storage stability in detonation sensitivity in a small diameter cartridge (diameter: 25 mm) and at low temperature.

The inventors have made various investigations for a long period of time in order to solve the above described problems, and found out that an aqueous solution consisting of water and ammonium nitrate, or a mixture of ammonium nitrate and the other oxidizer salt, and a combustible material consisting of fuel oil/wax can be formed into a W/O emulsion by the use of a compound which has not hitherto been considered as an emulsifier for W/O emulsion explosive composition; and further found out that the resulting W/O emulsion explosive composition is superior to W/O emulsion explosive compositions containing a commonly known emulsifier in storage stability in detonation sensitivity in a small diameter cartridge and at low temperature. As a result, the present invention has been accomplished.

SUMMARY OF THE INVENTION

The feature of the present invention is the provision of a water-in-oil emulsion explosive composition, comprising a disperse phase formed of an aqueous oxidizer solution consisting of (a) ammonium nitrate or a mixture of ammonium nitrate and the other inorganic oxidizer salt and (b) water; a continuous phase formed of a combustible material consisting of (c) fuel oil and/or wax; (d) at least one emulsifier selected from the group consisting of dipentaerythrytol fatty acid ester, polyoxyalkylenedipentaerythritol fatty acid ester, sugar fatty acid ester, polyoxyalkylenesugar fatty acid ester and sorbitol fatty acid ester; and (e) hollow microspheres or microbubbles.

DESCRIPTION OF THE PREFERRED EMBODIMENT

The aqueous oxidizer solution of the W/O emulsion explosive composition according to the present invention contains ammonium nitrate as a main component and may optionally contain another inorganic oxidizer salt. As the other inorganic oxidizer salt, use is made of, for example, nitrates of alkali metal or alkaline earth metal, such as sodium nitrate, calcium nitrate and the like. These inorganic oxidizer salts are used alone or in admixture. The compounding amount of ammonium nitrate is generally 50–94.7% by weight (hereinafter % means % by weight) based on the total amount of the resulting explosive composition, and the other inorganic oxidizer salts may be occasionally added to ammonium nitrate in an amount of not more than 40% based on the total amount of the ammonium nitrate and the other inorganic oxidizer salt.

When the compounding amount of ammonium nitrate is less than 50%, the oxygen balance (the relation between the amount of oxygen in the oxidizer and the amount of the combustible material) is improper (that is, the amount of oxygen is too small), and the resulting explosive composition is poor in the detonability and is large in the amount of after-detonation fume. While, when the compounding amount of ammonium nitrate exceeds 94.7%, a temperature required in the dissolving of ammonium nitrate into water is excessively high, the productivity of explosive composition is poor, and the explosion reactivity of ammonium nitrate is poor, and accordingly the resulting explosive composition is poor in the detonation sensitively.

The use of a small amount of the other inorganic oxidizer salt increases the feed amount of oxygen and can lower the dissolving temperature of ammonium nitrate in water, resulting in the improvement of detonability and productivity. While, when the amount of the other inorganic oxidizer salt exceeds 40%, the amount of remaining solid residue after explosion increases, and the strength of the resulting explosive composition is poor and the production of the explosive composition is expensive.

The compounding amount of water to be used in the aqueous oxidizer solution is generally 5–25% based on the total amount of the resulting explosive composition. When the compounding amount of water is less than 5%, an excessively high temperature is required in dissolving ammonium nitrate or a mixture of ammonium nitrate and the other inorganic oxidizer salt in water to lower the productivity of the explosive composition and to deteriorate the explosion reactivity thereof, and the detonation sensitivity of the resulting explosive composition is poor.

While, when the compounding amount of water exceeds 25%, ammonium nitrate or a mixture of ammonium nitrate and the other inorganic oxidizer salt can be dissolved in water at a low temperature, and therefore the productivity of the explosive composition can be improved. However, the amount of gas and the heat generated due to explosion are small, and therefore the resulting explosive composition is poor in the detonation sensitivity and in the strength.

The fuel oil of the fuel oil and/or wax includes, hydrocarbons, for example, paraffinic hydrocarbon, olefinic hydrocarbon, naphthenic hydrocarbon, aromatic hydrocarbon, other saturated or unsaturated hydrocarbon, petroleum, mineral oil, lubricant, liquid paraffin and the like; and hydrocarbon derivatives, such as nitrohydrocarbon and the like. The wax includes unpurified microcrystalline wax, purified microcrystalline wax and the like, which are derived from petroleum; mineral waxes, such as montan wax, ozokerite and the like; animal waxes, such as whale wax and the like; and insect waxes, such as beeswax and the like. These fuel oil and/or wax are used alone or in admixture. The compounding amount of these fuel oil and/or wax is generally 0.1–10% based on the total amount of the resulting explosive composition. When the compounding amount of the fuel oil and/or wax is less than 0.1%, the resulting W/O emulsion explosive composition is poor in the stability. While, when the compounding amount exceeds 10%, the oxygen balance is improper and a large amount of after-detonation fume is formed.

The dipentaerythritol fatty acid ester and polyoxyalkylenedipentaerythritol fatty acid ester to be used as an emulsifier for the W/O emulsion explosive composition of the present invention are represent by the following general formula (I), and include, for example, dipentaerythritol fatty acid esters, such as dipentaerythritol lauric acid monoester, dipentaerythritol isostearic acid monoester, dipentaerythritol oleic acid monoester, dipentaerythritol linoleic acid monoester, dipentaerythritol erucic acid monoester, dipentaerythritol linolenic acid tetraester and the like; and polyoxyalkylenedipentaerythritol fatty acid esters, such as polyoxyethylene(4)-dipentaerythritol isostearic acid tetraester, polyoxyethylene(6)-dipentaerythritol linoleic acid tetraester, polyoxypropylene(10)-dipentaerythritol erucic acid tetraester and the like.

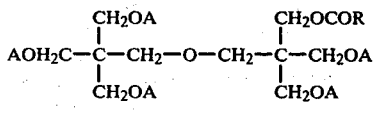

(I)

wherein A represents H, RCO— or $(OR')_mH$ (m=0–20), R represents $C_nH_{2n+1}$, $C_nH_{2n-1}$, $C_nH_{2n-3}$ or $C_nH_{2n-5}$ (n=9–24), and R' represents $$-CH_2CH_2- \text{ or } -\underset{\underset{CH_3}{|}}{CH}CH_2-.$$

The sugar fatty acid ester and polyoxyalkylenesugar fatty acid ester to be used as an emulsifier for the W/O emulsion explosive composition of the present invention are represented by the following general formulae (II) and (III), and include, for example, sugar fatty acid mono-, di- and tri-esters, such as sugar lauric acid monoester, sugar isostearic acid monoester, sugar oleic acid diester, sugar oleic acid triester, sugar erucic acid triester, sugar linoleic acid triester and the like; polyoxyalkylenesugar fatty acid triesters, such as polyoxyethylene(4)-sugar oleic acid triester, polyoxyethylene(4)-sugar linoleic acid triester, polyoxypropylene(6)-sugar erucic acid triester and the like; and polyoxyalkylenesugar fatty acid diesters.

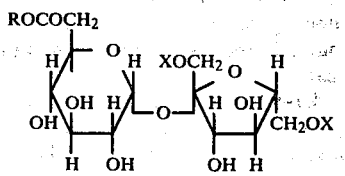

(II)

-continued

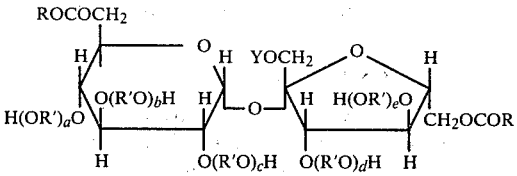

(III)

wherein X represents H or RCO—, Y represents H, RCO— or $(R'O)_fH$, R represents $C_nH_{2n+1}$, $C_nH_{2n-1}$, $C_nH_{2n-3}$ or $C_nH_{2n-5}$ (n=9–24), and R' represents $—CH_2CH_2—$ or $$—\underset{\underset{CH_3}{|}}{CH}CH_2—,$$

and a, b, c, d, e and f represent integers of 0–20.

The sorbitol fatty acid ester to be used as an emulsifier for the W/O emulsion explosive composition of the present invention is represented by the following general formula (IV), and includes, for example, sorbitol fatty acid mono-, di-, tri- and tetra-esters, such as sorbitol lauric acid monoester, sorbitol oleic acid monoester, sorbitol isostearic acid monoester, sorbitol linoleic acid monoester, sorbitol oleic acid diester, sobitol oleic acid triester, sorbitol oleic acid tetraester and the like.

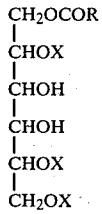

(IV)

wherein X represents H or RCO—, and R represents $C_nH_{2n+1}$, $C_nH_{2n-1}$, $C_nH_{2n-3}$ or $C_nH_{2n-5}$ (n=9–24).

The emulsifiers are used alone or in admixture. The compounding amount of these emulisifiers is generally 0.1–5%, and preferably 0.5–4%, based on the total amount of the resulting W/O emulsion explosive composition. When the compounding amount of the emulsifier is less than 0.1%, the resulting W/O emulsion explosive composition is poor in the storage stability in the detonation sensitivity in a small diameter cartridge and at low temperature. While when the compounding amount exceeds 5%, the oxygen balance is improper, and a large amount of after-detonation fume is formed, and the use of such large amount of emulsifier is not advantageous for commercial purpose.

Further, the density of the W/O emulsion explosive composition of the present invention is adjusted to 0.80–1.35, preferably 1.00–1.15, by using a density adjusting agent. The density adjusting agent includes hollow microspheres and/or microbubbles. As the hollow microspheres, use is made of inorganic hollow microspheres obtained from, for example, glass, alumina, shale, shirasu (shirasu is a kind of volcanic ash), silica, volcanic rock, sodium silicate, borax, perlite, obsidian and the like; carbonaceous hollow microspheres obtained from pitch, coal and the like; and synthetic resin hollow microspheres obtained from phenolic resin, polyvinylidene chloride, epoxy resin, urea resin and the like. These hollow microspheres are used alone or in admixture. The compounding amount of the hollow microspheres is generally 0.1–10% based on the total amount of the resulting W/O emulsion explosive composition. The microbubbles include microbubbles obtained by foaming a chemical foaming agent, microbubbles obtained by blowing mechanically air or other gases into the explosive composition during or after the formation of W/O emulsion, and the like.

As the chemical foaming agent, use is made of inorganic chemical foaming agents, such as alkali metal borohydride, a mixture of sodium nitrite and urea, and the like; and organic chemical foaming agents, such as N,N'-dinitrosopentamethylenetetramine, azodicarbonamide, azobisisobutyronitrile and the like. These chemical foaming agents are used alone or in admixture. The compounding amount of the chemical foaming agent is generally 0.01–2% based on the total amount of the resulting W/O emulsion explosive composition. When the compounding amount of the above described hollow microspheres is less than 0.1% or that of the chemical foaming agent is less than 0.01% or the blown amount of air or other gas is such a small amount that the resulting W/O emulsion explosive composition has a density of higher than 1.35, the resulting explosive composition is poor in the detonation sensitivity and further is low in the detonation velocity even when the explosive composition is detonated.

While, when the compounding amount of the hollow microspheres exceeds 10% or that of the chemical foaming agent exceeds 2% or the blown amount of air or other gas is such a large amount that the resulting W/O emulsion explosive composition has a density of less than 0.80, the resulting explosive composition has a good detonation sensitivity but is poor in the strength.

The W/O emulsion explosive composition of the present invention is produced, for example, in the following manner. That is, ammonium nitrate or a mixture of ammonium nitrate and the other inorganic oxidizer salt is dissolved in water at a temperature of about 80°–90° C. to obtain an aqueous oxidizer solution. Separately, an emulsifier defined in the present invention is melted at 80°–90° C. together with fuel oil and/or wax to obtain a combustible material mixture. Then, the combustible material mixture is firstly charged into a heat-insulating vessel of a certain capacity, and then the aqueous oxidizer solution is gradually added thereto while agitating the resulting mixture by means of a commonly used propeller blade-type agitator. After completion of the addition, the resulting mixture is further agitated at a rate of about 1,600 rpm for about 5 minutes to obtain a W/O emulsion kept at about 85° C. Then, the W/O emulsion is mixed with hollow microspheres or chemical foaming agent in a vertical type kneader while rotating the kneader at a rate of about 30 rpm, to obtain an aimed W/O emulsion explosive composition. When it is intended to produce a W/O emulsion explosive composition containing microbubbles of air or other gas in place of the production of a W/O emulsion explosive composition containing hollow microspheres or microbubbles formed by the decomposition of a chemical foaming agent, the above described W/O emulsion is agitated, while blowing air or other gas into the emulsion, to obtain an aimed W/O emulsion explosive composition.

The following examples are given for the purpose of illustration of this invention and are not intended as limitations thereof. In the examples, "parts" and "%" mean by weight.

EXAMPLE 1

A W/O emulsion explosive composition having a compounding recipe shown in the following Table 1 was produced in the following manner.

To 55.25 parts (11.05%) of water were added 381.5 parts (76.30%) of ammonium nitrate and 22.85 parts (4.57%) of sodium nitrate, and the resulting mixture was heated to about 85° C. to dissolve the nitrates in water and to obtain an aqueous solution of the oxidizer salts. While, a mixture of 8.75 parts (1.75%) of dipentaerythritol lauric acid monoester defined in the present invention and 17.05 parts (3.41%) of unpurified microcrystalline wax was heated and melted to obtain a combustible material mixture kept at about 85° C.

Into a heat-insulating vessel was charged the above described combustible material mixture, and then the above described aqueous solution of the oxidizer salts was gradually added thereto while agitating the resulting mixture by means of a propeller blade-type agitator. After completion of the addition, the resulting mixture was further agitated at a rate of about 1,600 rpm for 5 minutes to obtain a W/O emulsion kept at about 85° C. Then, the W/O emulsion was mixed with 14.60 parts (2.92%) of glass hollow microspheres having an average particle size of 75 μm in a vertical type kneader while rotating the kneader at a rate of about 30 rpm, to obtain a W/O emulsion explosive composition. The resulting W/O emulsion explosive composition was molded into a shaped article having a diameter of 25 mm and a length of about 180 mm and having a weight of 100 g, and the shaped article was packed with a viscose-processed paper to form a cartridge, which was used in the following performance tests. The performance tests are (1) the measurement of density one day after the production of the explosive composition, (2) the storage stability test for the detonation sensitivity, and (3) the measurement of the density at the detonation test in the storage stability test described in the above item (2). The storage stability test for detonation sensitivity described in the above item (2) was carried out in the following manner. A sample cartridge was kept at 60° C. for 24 hours and then kept at −15° C. for 24 hours, which was referred to as one temperature cycle. This temperature cycle was repeated to deteriorate compulsorily the sample cartridge, and then the sample cartridge was subjected to a detonation test at −5° C. by using a No. 6 blasting cap. The number of repeated temperature cycles, within which the sample cartridge was able to be completely detonated, was counted, and this number of the repeated temperature cycles was estimated as the number of storage months, within which the sample cartridge can be completely detonated, in the storage at room temperature (10°-30° C.). (It has been ascertained from experiments that the above described one temperature cycle corresponds substantially to one month storage at room temperature).

The obtained results are shown in the following Table 1.

EXAMPLES 2-11

A W/O emulsion explosive composition having a compounding recipe shown in Table 1 was produced according to Example 1, except that the dipentaerythritol lauric acid monoester used in Example 1 was replaced by dipentaerythritol isostearic acid monoester, dipentaerythritol oleic acid monoester, dipentaerythritol linoleic acid monoester, dipentaerythritol erucic acid diester, dipentaerythritol linolenic acid tetraester, polyoxyethylene(4)-dipentaerythritol isostearic acid tetraester, polyoxyethylene(6)-dipentaerythritol linoleic acid tetraester, polyoxypropylene(10)-dipentaerythritol erucic acid tetraester or their mixture.

A sample cartridge was produced from the above obtained W/O emulsion explosive composition in the same manner as described in Example 1, and subjected to the same performance tests as described in Example 1. The obtained results are shown in Table 1.

EXAMPLE 12

A W/O emulsion explosive composition having a compounding recipe shown in Table 1 was produced according to Example 1, except that the glass hollow microspheres used in Example 1 was replaced by N,N'-dinitrosopentamethylenetetramine. A sample cartridge was produced from the W/O emulsion explosive composition in the same manner as described in Example 1. The sample cartridge was heated in a thermostat kept at about 50° C. for 2 hours to decompose and foam the foaming agent (N,N'-dinitrosopentamethylenetetramine) contained therein, whereby the density of the emulsion explosive composition was adjusted. The above treated sample cartridge was subjected to the same performance tests described in Example 1. The obtained results are shown in Table 1.

EXAMPLE 13

A W/O emulsion explosive composition having a compounding recipe shown in Table 1 was produced by the following method. That is, a W/O emulsion was produced according to Example 1, and then the W/O emulsion ws agitated at a rate of about 1,600 rpm for 2 minutes by means of a propeller blade-type agitator, while blowing air into the emulsion through a nozzle having a small diameter, to introduce microbubbles into the emulsion and to obtain a W/O emulsion explosive composition having a given density.

A sample cartridge was produced from the above obtained W/O emulsion explosive composition in the same manner as described in Example 1, and subjected to the same performance tests as described in Example 1. The obtained results are shown in Table 1.

TABLE 1(a)

| | | | Example | | | | | | | | | | | | |
|---|---|---|---|---|---|---|---|---|---|---|---|---|---|---|---|
| | | | 1 | 2 | 3 | 4 | 5 | 6 | 7 | 8 | 9 | 10 | 11 | 12 | 13 |
| Compounding recipe (%) | Aqueous oxidizer solution | Ammonium nitrate | 76.30 | 76.30 | 76.30 | 76.30 | 76.30 | 76.30 | 76.30 | 76.30 | 76.30 | 49.70 | 49.70 | 78.44 | 78.60 |
| | | Sodium nitrate | 4.57 | 4.57 | 4.57 | 4.57 | 4.57 | 4.57 | 4.57 | 4.57 | 4.57 | 12.40 | 12.40 | 4.70 | 4.71 |
| | | Calcium nitrate | — | — | — | — | — | — | — | — | — | 12.40 | 12.40 | — | — |
| | | Water | 11.05 | 11.05 | 11.05 | 11.05 | 11.05 | 11.05 | 11.05 | 11.05 | 11.05 | 11.20 | 11.20 | 11.36 | 11.38 |
| | Combustible material | Unpurified microcrystalline wax | 3.41 | 3.41 | 3.41 | 3.41 | 3.41 | 3.41 | 3.41 | 3.41 | 3.41 | — | — | 3.50 | 3.51 |
| | | Liquid paraffin | — | — | — | — | — | — | — | — | — | 4.30 | 4.30 | — | — |
| | Emul- | Dipentaerythritol | 1.75 | — | — | — | — | — | — | — | — | — | — | — | — |

TABLE 1(a)-continued

| | | | Example | | | | | | | | | | | | |
|---|---|---|---|---|---|---|---|---|---|---|---|---|---|---|---|
| | | | 1 | 2 | 3 | 4 | 5 | 6 | 7 | 8 | 9 | 10 | 11 | 12 | 13 |
| | sifier | lauric acid monoester | | | | | | | | | | | | | |
| | | Dipentaerylthritol isostearic acid monoester | — | 1.75 | — | — | — | — | — | — | — | — | — | — | — |
| | | Dipentaerythritol oleic acid monoester | — | — | 1.75 | — | — | — | — | — | — | — | 0.80 | — | — |
| | | Dipentaerythritol linoleic acid monoester | — | — | — | 1.75 | — | — | — | — | — | — | — | — | — |
| | | Dipentaerythritol erucic acid diester | — | — | — | — | 1.75 | — | — | — | — | 2.50 | 0.80 | 1.80 | 1.80 |
| | | Dipentaerythritol linolenic acid tetraester | — | — | — | — | — | 1.75 | — | — | — | — | — | — | — |

TABLE 1(b)

| | | | Example | | | | | | | | | | | | |
|---|---|---|---|---|---|---|---|---|---|---|---|---|---|---|---|
| | | | 1 | 2 | 3 | 4 | 5 | 6 | 7 | 8 | 9 | 10 | 11 | 12 | 13 |
| Compounding recipe (%) | Emulsifier | Polyoxyethylene(4)-dipentaerythritol isostearic acid tetraester | — | — | — | — | — | — | 1.75 | — | — | — | — | — | — |
| | | Polyoxyethylene(6)-dipentaerythritol linoleic acid tetraester | — | — | — | — | — | — | — | 1.75 | — | — | — | — | — |
| | | Polyoxypropylene(10)-dipentaerythritol erucic acid tetraester | — | — | — | — | — | — | — | — | 1.75 | — | 0.90 | — | — |
| | Others | Glass hollow micropheres | 2.92 | 2.92 | 2.92 | 2.92 | 2.92 | 2.92 | 2.92 | 2.92 | 2.92 | — | — | — | — |
| | | Silica hollow microspheres | — | — | — | — | — | — | — | — | — | 7.50 | 7.50 | — | — |
| | | N,N'—Dinitrosopentamethylenetetramine | — | — | — | — | — | — | — | — | — | — | — | 0.20 | — |
| Performance | Density one day after the production | | 1.06 | 1.05 | 1.09 | 1.07 | 1.07 | 1.08 | 1.06 | 1.06 | 1.07 | 1.09 | 1.08 | 1.09 | 1.09 |
| | Storage stability in detonation sensitivity (number of complete detonation months) | | 23 | 25 | 25 | 26 | 27 | 27 | 23 | 24 | 26 | 32 | 33 | 21 | 20 |
| | Density at the final complete detonation | | 1.08 | 1.06 | 1.09 | 1.09 | 1.08 | 1.08 | 1.09 | 1.08 | 1.07 | 1.10 | 1.09 | 1.11 | 1.10 |

EXAMPLES 14–24

A W/O emulsion explosive composition having a compounding recipe shown in Table 2 was produced according to Example 1, except that the dipentaerythritol lauric acid monoester used in Example 1 was replaced by sugar lauric acid monoester, sugar isostearic acid monoester, sugar oleic acid diester, sugar oleic acid triester, sugar erucic acid triester, sugar linoleic acid triester, polyoxyethylene(4)-sugar oleic acid triester, polyoxyethylene(4)-sugar linoleic acid triester, polyoxypropylene(6)-sugar erucic acid triester or their mixture.

A sample cartridge was produced from the above obtained W/O emulsion explosive composition in the same manner as described in Example 1, and subjected to the same performance tests as described in Example 1. The obtained results are shown in Table 2.

EXAMPLES 25 and 26

A W/O emulsion explosive composition having a compounding recipe shown in Table 2 was produced according to Examples 12 and 13. A sample cartridge was produced from the above obtained W/O emulsion explosive composition according to Examples 12 and 13, and subjected to the same performance tests as described in Example 1. The obtained results are shown in Table 2.

TABLE 2(a)

| | | | Example | | | | | | | | | | | | |
|---|---|---|---|---|---|---|---|---|---|---|---|---|---|---|---|
| | | | 14 | 15 | 16 | 17 | 18 | 19 | 20 | 21 | 22 | 23 | 24 | 25 | 26 |
| Compounding recipe (%) | Aqueous oxidizer solution | Ammonium nitrate | 76.30 | 76.30 | 76.30 | 76.30 | 76.30 | 76.30 | 76.30 | 76.30 | 76.30 | 49.70 | 49.70 | 78.44 | 78.60 |
| | | Sodium nitrate | 4.57 | 4.57 | 4.57 | 4.57 | 4.57 | 4.57 | 4.57 | 4.57 | 4.57 | 12.40 | 12.40 | 4.70 | 4.71 |
| | | Calcium nitrate | — | — | — | — | — | — | — | — | — | 12.40 | 12.40 | — | — |
| | | Water | 11.05 | 11.05 | 11.05 | 11.05 | 11.05 | 11.05 | 11.05 | 11.05 | 11.05 | 11.20 | 11.20 | 11.36 | 11.38 |
| | Combustible material | Unpurified microcrystalline wax | 3.41 | 3.41 | 3.41 | 3.41 | 3.41 | 3.41 | 3.41 | 3.41 | 3.41 | — | — | 3.50 | 3.51 |
| | | Liquid paraffin | — | — | — | — | — | — | — | — | — | 4.30 | 4.30 | — | — |
| | Emul- | Sugar lauric acid | 1.75 | — | — | — | — | — | — | — | — | — | — | — | — |

TABLE 2(a)-continued

| | | | Example | | | | | | | | | | | | |
|---|---|---|---|---|---|---|---|---|---|---|---|---|---|---|---|
| | | | 14 | 15 | 16 | 17 | 18 | 19 | 20 | 21 | 22 | 23 | 24 | 25 | 26 |
| | sifier | monoester | | | | | | | | | | | | | |
| | | Sugar isostearic acid monoester | — | 1.75 | — | — | — | — | — | — | — | — | — | — | — |
| | | Sugar oleic acid diester | — | — | 1.75 | — | — | — | — | — | — | — | — | — | — |
| | | Sugar oleic acid triester | — | — | — | 1.75 | — | — | — | — | — | 2.50 | 1.25 | 1.80 | 1.80 |
| | | Sugar erucic acid triester | — | — | — | — | 1.75 | — | — | — | — | — | — | — | — |
| | | Sugar linoleic acid triester | — | — | — | — | — | 1.75 | — | — | — | — | — | — | — |

TABLE 2(b)

| | | | Example | | | | | | | | | | | | |
|---|---|---|---|---|---|---|---|---|---|---|---|---|---|---|---|
| | | | 14 | 15 | 16 | 17 | 18 | 19 | 20 | 21 | 22 | 23 | 24 | 25 | 26 |
| Compounding recipe (%) | Emulsifier | Polyoxyethylene(4)-sugar oleic acid-triester | — | — | — | — | — | — | 1.75 | — | — | — | 1.25 | — | — |
| | | Polyoxyethylene(4)-sugar linoleic acid triester | — | — | — | — | — | — | — | 1.75 | — | — | — | — | — |
| | | Polyoxypropylene(6)-sugar erucic acid triester | — | — | — | — | — | — | — | — | 1.75 | — | — | — | — |
| | Others | Glass hollow microspheres | 2.92 | 2.92 | 2.92 | 2.92 | 2.92 | 2.92 | 2.92 | 2.92 | 2.92 | — | — | — | — |
| | | Silica hollow microspheres | — | — | — | — | — | — | — | — | — | 7.50 | 7.50 | — | — |
| | | N,N'—Dinitrosopentamethylenetetramine | — | — | — | — | — | — | — | — | — | — | — | 0.20 | — |
| Performance | Density one day after the production | | 1.08 | 1.05 | 1.07 | 1.08 | 1.06 | 1.08 | 1.05 | 1.07 | 1.09 | 1.08 | 1.05 | 1.06 | 1.08 |
| | Storage stability in detonation sensitivity (number of complete detonation months) | | 23 | 24 | 26 | 28 | 27 | 29 | 25 | 26 | 27 | 33 | 31 | 19 | 20 |
| | Density at the final complete detonation | | 1.09 | 1.08 | 1.09 | 1.08 | 1.07 | 1.10 | 1.07 | 1.09 | 1.10 | 1.09 | 1.08 | 1.09 | 1.10 |

EXAMPLES 27–33

A W/O emulsion explosive composition having a compounding recipe shown in Table 3 was produced according to Example 1, except that the dipentaerythritol lauric acid monoester used in Example 1 was replaced by sorbitol lauric acid monoester, sorbitol isostearic acid monoeser, sorbitol linoleic acid monoester, sorbitol oleic acid diester, sorbitol oleic acid triester or sorbitol oleic acid tetraester.

A sample cartridge was produced from the above obtained W/O emulsion explosive composition in the same manner as described in Example 1, and subjected to the same performance tests as described in Example 1. The obtained results are shown in Table 3.

EXAMPLES 34 and 35

A W/O emulsion explosive composition having a compounding recipe shown in Table 3 was produced according to Examples 12 and 13. A sample cartridge was produced from the above obtained W/O emulsion explosive composition according to Examples 12 and 13, and subjected to the same performance tests as described in Example 1. The obtained results are shown in Table 3.

TABLE 3(a)

| | | | Example | | | | | | | | |
|---|---|---|---|---|---|---|---|---|---|---|---|
| | | | 27 | 28 | 29 | 30 | 31 | 32 | 33 | 34 | 35 |
| Compounding recipe (%) | Aqueous oxidizer solution | Ammonium nitrate | 76.30 | 76.30 | 76.30 | 76.30 | 76.30 | 76.30 | 49.70 | 78.44 | 78.60 |
| | | Sodium nitrate | 4.57 | 4.57 | 4.57 | 4.57 | 4.57 | 4.57 | 12.40 | 4.70 | 4.71 |
| | | Calcium nitrate | — | — | — | — | — | — | 12.40 | — | — |
| | | Water | 11.05 | 11.05 | 11.05 | 11.05 | 11.05 | 11.05 | 11.20 | 11.36 | 11.38 |
| | Combustible material | Unpurified microcrystalline wax | 3.41 | 3.41 | 3.41 | 3.41 | 3.41 | 3.41 | — | 3.50 | 3.51 |
| | | Liquid paraffin | — | — | — | — | — | — | 4.30 | — | — |
| | Emulsifier | Sorbitol lauric acid monoester | 1.75 | — | — | — | — | — | — | — | — |
| | | Sorbitol isostearic acid monoester | — | 1.75 | — | — | — | — | — | — | — |
| | | Sorbitol linoleic acid monoester | — | — | 1.75 | — | — | — | — | — | — |
| | | Sorbitol oleic acid diester | — | — | — | 1.75 | — | — | 2.50 | 1.80 | 1.80 |
| | | Sorbitol oleic acid triester | — | — | — | — | 1.75 | — | — | — | — |
| | | Sorbitol oleic acid tetraester | — | — | — | — | — | 1.75 | — | — | — |

TABLE 3(b)

| | | | Example | | | | | | | | |
|---|---|---|---|---|---|---|---|---|---|---|---|
| | | | 27 | 28 | 29 | 30 | 31 | 32 | 33 | 34 | 35 |
| Compounding recipe (%) | Others | Glass hollow microspheres | 2.92 | 2.92 | 2.92 | 2.92 | 2.92 | 2.92 | — | — | — |
| | | Silica hollow microspheres | — | — | — | — | — | — | 7.50 | — | — |
| | | N,N'—Dinitrosopenta-methylenetetramine | — | — | — | — | — | — | — | 0.20 | — |
| Performance | Density one day after the production | | 1.07 | 1.07 | 1.06 | 1.08 | 1.07 | 1.09 | 1.10 | 1.05 | 1.07 |
| | Storage stability in detonation sensitivity (number of complete detonation months) | | 23 | 25 | 27 | 29 | 26 | 28 | 31 | 21 | 21 |
| | Density at the final complete detonation | | 1.09 | 1.08 | 1.09 | 1.08 | 1.10 | 1.09 | 1.10 | 1.09 | 1.10 |

COMPARATIVE EXAMPLES 1–8

A W/O emulsion explosive composition having a compounding recipe shown in Table 4 was produced according to Example 1. A sample cartridge was produced from the above obtained W/O emulsion explosive composition in the same manner as described in Example 1, and subjected to the same performance tests as described in Example 1. The obtained results are shown in Table 4.

COMPARATIVE EXAMPLES 9 and 10

A W/O emulsion explosive composition having a compounding recipe shown in Table 4 was produced according to Examples 12 and 13. A sample cartridge was produced from the above obtained W/O emulsion explosive composition in the same manner as described in Example 1, and subjected to the same performance tests as described in Example 1. The obtained results are shown in Table 4.

TABLE 4(a)

| | | | Comparative example | | | | | | | | | |
|---|---|---|---|---|---|---|---|---|---|---|---|---|
| | | | 1 | 2 | 3 | 4 | 5 | 6 | 7 | 8 | 9 | 10 |
| Compounding recipe (%) | Aqueous oxidizer solution | Ammonium nitrate | 76.30 | 76.30 | 76.30 | 76.30 | 76.30 | 76.30 | 76.30 | 49.70 | 78.44 | 78.60 |
| | | Sodium nitrate | 4.57 | 4.57 | 4.57 | 4.57 | 4.57 | 4.57 | 4.57 | 12.40 | 4.70 | 4.71 |
| | | Calcium nitrate | — | — | — | — | — | — | — | 12.40 | — | — |
| | | Water | 11.05 | 11.05 | 11.05 | 11.05 | 11.05 | 11.05 | 11.05 | 11.20 | 11.36 | 11.38 |
| | Combustible material | Unpurified microcrystalline wax | 3.41 | 3.41 | 3.41 | 3.41 | 3.41 | 3.41 | 3.41 | — | 3.50 | 3.51 |
| | | Liquid paraffin | — | — | — | — | — | — | — | 4.50 | — | — |
| | Emulsifier | Sorbitan monooleic acid ester | 1.75 | — | — | — | — | — | — | 2.50 | 1.80 | 1.80 |
| | | Polyoxyethylene(1)-sorbitol monooleic acid ester | — | 1.75 | — | — | — | — | — | — | — | — |
| | | Glycerine monooleic acid ester | — | — | 1.75 | — | — | — | — | — | — | — |
| | | Polyoxyethylene(2) oleyl ether | — | — | — | 1.75 | — | — | — | — | — | — |
| | | Polyoxyethylene(2) oleic acid ester | — | — | — | — | 1.75 | — | — | — | — | — |
| | | Phosphoric acid oleic acid ester | — | — | — | — | — | 1.75 | — | — | — | — |
| | | 4,4-Bishydroxy-2-oleyl-2-oxazoline | — | — | — | — | — | — | 1.75 | — | — | — |

TABLE 4(b)

| | | | Comparative example | | | | | | | | | |
|---|---|---|---|---|---|---|---|---|---|---|---|---|
| | | | 1 | 2 | 3 | 4 | 5 | 6 | 7 | 8 | 9 | 10 |
| Compounding recipe (%) | Others | Glass hollow microspheres | 2.92 | 2.92 | 2.92 | 2.92 | 2.92 | 2.92 | 2.92 | — | — | — |
| | | Silica hollow microspheres | — | — | — | — | — | — | — | 7.50 | — | — |
| | | N,N'—Dinitrosopenta-methylenetetramine | — | — | — | — | — | — | — | — | 0.20 | — |
| Performance | Density one day after the production | | 1.08 | 1.12 | 1.07 | 1.09 | 1.09 | 1.08 | 1.07 | 1.09 | 1.05 | 1.09 |
| | Storage stability in detonation sensitivity (number of complete detonation months) | | 19 | 6 | 17 | 13 | 12 | 18 | 18 | 24 | 14 | 13 |
| | Density at the final complete detonation | | 1.09 | 1.13 | 1.09 | 1.10 | 1.09 | 1.10 | 1.08 | 1.11 | 1.11 | 1.13 |

The results of Examples will be explained in comparison with the results of Comparative examples.

The W/O emulsion explosive compositions (Examples 1–9), which contained, as an emulsifier defined in the present invention, dipentaerythritol lauric acid monoester, dipentaerythritol isostearic acid monoester, dipentaerythritol oleic acid monoester, dipentaerythritol linoleic acid monoester, dipentaerythritol erucic acid diester, dipentaerythritol linolenic acid tetraester, polyoxyethylene(4)-dipentaerythritol isostearic acid tetraester, polyoxyethylene(6)-dipentaerythritol linoleic acid tetraester or polyoxypropylene(10)-dipentaerythritol erucic acid tetraester, had a storage life of 23–27 months, within which the explosive composition was able to be completely detonated at −5° C. by means of a No. 6 blasting cap.

The W/O emulsion explosive compositions (Examples 14–20), which contained, as an emulsifier defined in the present invention, sugar lauric acid monoester, sugar isostearic acid monoester, sugar oleic acid diester, sugar oleic acid triester, sugar erucic acid triester, sugar linoleic acid triester, polyoxyethylene(4)-sugar oleic acid triester, polyoxyethylene(4)-sugar linoleic acid triester or polyoxypropylene(6)-sugar erucic acid triester, had a storage life of 23–29 months, within which the explosive composition was able to be completely detonated at −5° C. by means of a No. 6 blasting cap.

The W/O emulsion explosive compositions (Examples 27–32), which contained, as an emulsifier defined in the present invention, sorbitol lauric acid monoester, sorbitol isostearic acid monoester, sorbitol linoleic acid monoester, sorbitol oleic acid diester, sorbitol oleic acid triester or sorbitol oleic acid tetraester, had a storage life of 23–29 months, within which the explosive composition was able to be completely detonated at −5° C. by means of a No. 6 blasting cap.

While, the W/O emulsion explosive compositions (Comparative examples 1–7) containing a commonly known emulsifier had a storage life of 6–19 months, within which the explosive composition was able to be completely detonated at −5° C. by means of a No. 6 blasting cap.

The W/O emulsion explosive composition of Comparative example 8, which contained sodium nitrate and calcium nitrate as an inorganic oxidizer salt other than ammonium nitrate, liquid paraffin as a plasticizer, silica hollow microspheres as a gas-retaining agent, and 2.50% of sorbitan monooleic acid ester as an emulsifier, had a storage life of 24 months, within which the explosive composition was able to be completely detonated at −5° C. by means of a No. 6 blasting cap; while the W/O emulsion explosive composition of Example 10, which had the same composition as that of the explosive composition of Comparative example 8, except that 2.50% of dipentaerythritol erucic acid diester as an emulsifier defined in the present invention was contained in place of the sorbitan monooleic acid ester used in Comparative example 8, had the life of 32 months; the W/O emulsion explosive composition of Example 23, which had the same composition as that of the explosive composition of Comparative example 8, except that 2.50% of sugar oleic acid triester was contained in place of the sorbitan monooleic acid ester, had the life of 33 months; the W/O emulsion explosive composition of Example 33, which had the same composition as that of the explosive composition of Comparative example 8, except that 2.50% of sorbitol oleic acid diester was contained in place of the sorbitan monooleic acid ester, had the life of 31 months; the W/O emulsion explosive composition of Example 11, which had the same composition as that of the explosive composition of Comparative example 8, except that 0.80% of dipentaerythritol oleic acid monoester, 0.80% of dipentaerythritol erucic acid diester and 0.90% of polyoxypropylene(10)-dipentaerythritol erucic acid tetraester were contained in place of the sorbitan monooleic acid ester, had the life of 33 months; and the W/O emulsion explosive composition of Example 24, which had the same composition as that of the explosive composition of Comparative example 8, except that 1.25% of sugar oleic acid triester and 1.25% of polyoxyethylene(4)-sugar oleic acid triester were contained in place of the sorbitan monooleic acid ester, had the life of 31 months.

The W/O emulsion explosive composition of Comparative example 9, whose density was adjusted by adding thereto 0.20% of a chemical foaming agent of N,N'-dinitrosopentamethylenetetramine without the use of a gas-retaining agent and which contained 1.80% of sorbitan monooleic acid ester as an emulsifier, had a storage life of 14 months, within which the explosive composition was able to be completely detonated at −5° C. by means of a No. 6 blasting cap; while the W/O emulsion explosive composition of Example 12, which had the same composition as that of the explosive composition of Comparative example 9, except that 1.80% of dipentaerythritol erucic acid diester as an emulsifier defined in the present invention was contained in place of the sorbitan monooleic acid ester used in Comparative example 9, had the life of 21 months; the W/O emulsion explosive composition of Example 25, which had the same composition as that of the explosive composition of Comparative example 9, except that 1.80% of sugar oleic acid triester was contained in place of the sorbitan monooleic acid ester, had the life of 19 months; and the W/O emulsion explosive composition of Example 34, which had the same composition a that of the explosive composition of Comparative example 9, except that 1.80% of sorbitol oleic acid diester was contained in place of the sorbitan monooleic acid ester, had the life of 21 months.

Further, the W/O emulsion explosive composition of Comparative example 10, whose density was adjusted by blowing mechanically microbubbles thereinto without the use of a gas-retaining agent, and which contained 1.80% of sorbitan monooleic acid ester as an emulsifier, had a storage life of 13 months, within which the explosive composition was able to be completely detonated at −5° C. by means of a No. 6 blasting cap; while the W/O emulsion explosive compositions of Examples 13, 26 and 35, which had the same composition as that of the explosive composition of Comparative example 10, except that 1.80% of dipentaerythritol erucic acid diester, sugar oleic acid triester and sorbitol oleic acid diester as an emulsifier defined in the present invention were contained in place of the sorbitan monooleic acid ester used in Comparative example 10, had the lifes of 20, 20 and 21 months, respectively.

It can be seen from the above described comparison of the Examples with the Comparative examples that the W/O emulsion explosive composition containing the emulsifier defined in the present invention is remarkably superior to the W/O emulsion explosive composition containing a conventional emulsifier in the storage stability in the detonation sensitivity in a small diameter cartridge (diameter: 25 mm) and at low temperature.

We claim:

1. A water-in-oil emulsion explosive composition, comprising a disperse phase formed of an aqueous oxidizer solution consisting of (a) ammonium nitrate or a mixture of ammonium nitrate and sodium nitrate and (b) water; a continuous phase formed of a combustible material consisting of (c) fuel oil and/or wax; (d) at least one emulsifier selected from the group consisting of dipentaerythritol fatty acid ester, polyoxyalkylenedipentaerythritol fatty acid ester, sugar fatty acid ester and polyoxyalkylenesugar fatty acid ester; and (e) hollow microspheres or microbubbles.

2. A water-in-oil emulsion explosive composition according to claim 1, wherein said dipentaerythritol fatty acid ester and polyoxyalkylenedipentaerythritol fatty acid ester are represented by the following general formula (I)

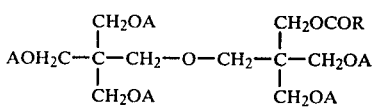

(I)

wherein A represents H, RCO— or $(OR')_mH$ (m=0–20) and R represents $C_nH_{2n+1}$, $C_nH_{2n-1}$, $C_nH_{2n-3}$ or $C_nH_{2n-5}$ (n=9-24), and R' represents —$CH_2CH_2$— or $$-\underset{\underset{CH_3}{|}}{CH}CH_2-.$$

3. A water-in-oil emulsion explosive composition according to claim 1, wherein said sugar fatty acid ester is represented by the following general formula (II)

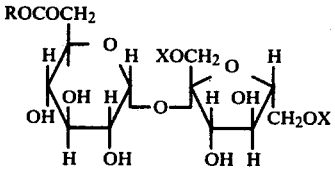

(II)

wherein X represents H or RCO—, R represents $C_nCH_{2n+1}$, $C_nH_{2n-1}$, $C_nH_{2n-3}$ or $C_nH_{2n-5}$ (n=9-24).

4. A water-in-oil emulsion explosive composition according to claim 1, wherein said polyoxyalkylenesugar fatty acid ester is represented by the following general formula (III)

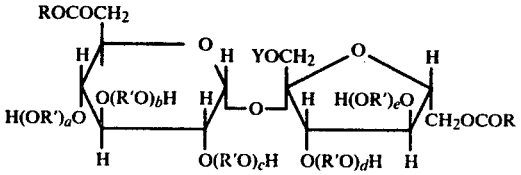

(III)

wherein Y represents H, RCO— or $(R'O)_fH$, R represents $C_nH_{2n+1}$, $C_nH_{2n-1}$, $C_nH_{2n-3}$ or $C_nH_{2n-5}$ (n=9-24), and R' represents —$CH_2CH_2$— or $$-\underset{\underset{CH_3}{|}}{CH}CH_2-,$$

and a, b, c, d, e and f represent integers of 0-20.

5. A water-in-oil emulsion explosive composition according to claim 1, 2, 3 or 4, which comprises 50-94.7% by weight of ammonium nitrate or a mixture of ammonium nitrate and sodium nitrate, the amount of said sodium nitrate being not larger than 40% by weight based on the amount of the mixture of ammonium nitrate and sodium nitrate, 5-25% by weight of water, 0.1-10% by weight of fuel oil and/or wax, 0.1-5% by weight of an emulsifier and 0.1-10% by weight of hollow microspheres.

6. A water-in-oil emulsion explosive composition according to claim 1, 2, 3, 4 or 5, wherein the amount of the emulsifier is 0.5-4% by weight based on the total amount of the explosive composition.

7. A water-in-oil explosive composition according to claim 1, wherein said composition has a density of 0.8-1.15.

8. A water-in-oil explosive composition according to claim 1, wherein said composition has a density of 1.00-1.15.

* * * * *